US008082980B2

(12) United States Patent
Gillan

(10) Patent No.: US 8,082,980 B2
(45) Date of Patent: Dec. 27, 2011

(54) DOWNHOLE WELL ACCESS LINE CUTTING TOOL

(75) Inventor: Peter Gillan, Denend (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 152 days.

(21) Appl. No.: 12/357,150

(22) Filed: Jan. 21, 2009

(65) Prior Publication Data

US 2010/0181072 A1 Jul. 22, 2010

(51) Int. Cl.
*E21B 29/04* (2006.01)

(52) U.S. Cl. ..... 166/54.5

(58) Field of Classification Search ..... 166/54.5, 166/54.6, 55.6, 55.7, 55.8
See application file for complete search history.

(56) References Cited

U.S. PATENT DOCUMENTS 2,185,303 A * 1/1940 Kinley ..... 166/54.6
3,926,252 A * 12/1975 Ribeyre et al. ..... 166/54.6
6,629,568 B2 * 10/2003 Post et al. ..... 166/382
6,834,721 B2 12/2004 Suro
7,073,448 B2 7/2006 Bell
7,086,467 B2 8/2006 Schlegelmilch et al.
7,128,155 B2 10/2006 Cho
7,143,843 B2 * 12/2006 Doering et al. ..... 175/24
7,225,873 B2 6/2007 Schlegelmilch et al.
7,314,088 B2 1/2008 Betts et al.
7,422,055 B2 9/2008 Cruickshank et al.
2004/0038131 A1 * 2/2004 Den Boer et al. ..... 429/304
2007/0131410 A1 * 6/2007 Hill et al. ..... 166/55.8
2008/0236830 A1 * 10/2008 Fuhst et al. ..... 166/298

* cited by examiner

*Primary Examiner* — Daniel P Stephenson
*Assistant Examiner* — Blake Michener
(74) *Attorney, Agent, or Firm* — Michael L. Flynn; Daivd R. Hofman; Jody Lynn DeStefanis

(57) ABSTRACT

A cutting tool for cutting a wireline, slickline, coiled tubing, or other well access line stuck downhole in a well. The tool includes a host of features including a propulsion mechanism to aid in delivering the tool to a predetermined cut location of the line. In this manner, the risk of unintended uphole cutting of the line may be minimized.

22 Claims, 8 Drawing Sheets

DOWNHOLE WELL ACCESS LINE CUTTING TOOL

FIELD

Embodiments described relate to oilfield well operations. In particular, applications for cutting and removing a well access line from a well that has been stuck downhole for any number of reasons. The well access line may be wireline, slickline, coiled tubing or any of a host of downhole conveyance mechanisms, generally with a tool or toolstring disposed at a downhole end thereof.

BACKGROUND

Exploring, drilling, completing, and operating hydrocarbon and other wells are generally complicated, time consuming and ultimately very expensive endeavors. In recognition of these expenses, added emphasis has been placed on well access, monitoring and management throughout its productive life. Well intervention and ready access to well information may play critical roles in maximizing the life of the well and total hydrocarbon recovery. As a result, downhole tools are frequently deployed within a given hydrocarbon well throughout its life. These tools may include logging tools to provide well condition information. Alternatively, these tools may include devices for stimulating hydrocarbon flow, removing debris or scale, or addressing a host of other well issues.

The above noted downhole tools are generally delivered to a downhole location by way of a well access line. A well access line may include a wireline or slickline cable, coiled tubing, and other forms of downhole conveyance line. Regardless, once delivered downhole, a well application may proceed employing the tool. Subsequently, a winch-driven drum at the surface of the oilfield may be used to withdraw the well access line and tool from the well. Unfortunately, however, the well access line and/or tool often become stuck in place downhole. This may be due to the presence of an unforeseen obstruction, unaccounted for restriction, differential sticking of the tool against the well wall, or a host of other reasons.

In the case of wireline cable, a weak-point is generally built into the cable head where the tool and cable are joined. Thus, when sticking occurs, the winch may continue to pull uphole on the line until a break occurs at the weak-point. Subsequently, a fishing operation may ensue to retrieve the stuck tool from the well. Unfortunately, slickline, coiled tubing, and other conveyances often lack a built-in weak-point. Thus, at best, continued pulling on the line will only result in an uncontrolled break, generally nearer the oilfield surface. Such an uncontrolled break may leave the well obstructed by thousands of feet of line that will only add to the time, effort, and expense of the follow-on fishing operation. Furthermore, even where a weak-point is built into the assembly, break failure of the weak-point often occurs. This may be due to a design or manufacturing flaw, or other reasons. Regardless the reason, failure of the weak-point to break may result in an uncontrolled break as noted above.

In the case of wireline or other non-tubing conveyances, cutting bars are often employed in an attempt to avoid uncontrolled breaking of the line. A cutting bar is a pipe equipped with an internal cutting mechanism. The bar may be positioned over the line and dropped vertically into the well. In theory, the bar will drop until it reaches the sticking location, at which point the sudden stopping of the bar will actuate the cutting mechanism and induce a break in the line.

Unfortunately, employing a cutting bar may still result in breaking the line at a location uphole of the sticking location. This is due to the fact that the described cutting bar technique proceeds blindly. So, for example, in the case of a deviated well, the cutting bar will stop dropping and cut the line as soon as a bend or deviation is encountered which may be nowhere near the targeted sticking location. Similarly, a slight narrowing in the well, or minimal obstruction unrelated to the sticking of the line, may be enough to stop the fall of the cutting bar. Either way, the cutting bar may stop uphole of the sticking location, induce a break in the line, and add tremendous time and expense to the follow-on fishing operation.

As an alternative to the cutting bar, a timed cutter may be deployed within the well. That is, a cutter equipped with a cutting mechanism that is activated based on a timer may be dropped into the well. In this way, temporary stopping of the cutter, for example, upon encountering a minor obstruction, may not result in activation of the cutting mechanism. Rather, the cutting mechanism may be activated only after a set period of time, presumably after bypassing any such minor temporary obstructions.

Unfortunately, the use of a timed cutter fails to overcome uncontrolled line breaks in circumstances of deviated wells or in the face of significant well obstructions. In such cases, the activation of the cutting mechanism is still likely to take place well uphole of the sticking location. That is, the mode of cutting remains blind and thus, susceptible to breaking the line well uphole of the targeted sticking location. Furthermore, in the case of coiled tubing, similar cutting mechanisms may be employed that generally involve the initial deployment of a cable interior of tubing so that follow-on cutting techniques may be carried out. However, such techniques remain blind and susceptible to inducing coiled tubing breaks uphole of the targeted sticking location. In fact, in the case of coiled tubing, the cutting techniques generally require cutting of the coiled tubing at the location of the drum in order to deploy the interior cable. As a result, large amounts of coiled tubing are rendered ineffective for future use. Thus, in many cases, the operator may ultimately be left with no better option than to run a blind attempt at cutting the line which runs a significant likelihood of adding several hundred thousand dollars of expense to future fishing and other operations.

SUMMARY

A cutting tool is provided for cutting a well access line downhole in a well. The tool includes a housing which accommodates an active propulsion mechanism for driving the tool along the well access line to a cut location thereof. A cutting mechanism is also accommodated by the housing in order to achieve cutting of the well access line at the cut location.

DETAILED DESCRIPTION

Embodiments are described with reference to certain downhole tool operations at an oilfield. For example, primarily wireline based tractor driven logging operations are described throughout. However, alternate downhole operations employing different types of well access line, including coiled tubing, may utilize embodiments of cutting tools as described herein. Of particular note, these cutting tool embodiments may be equipped with a propulsion mechanism configured to actively drive the cutting tools along the well access line to a deliberately targeted cut location.

Figure 1:
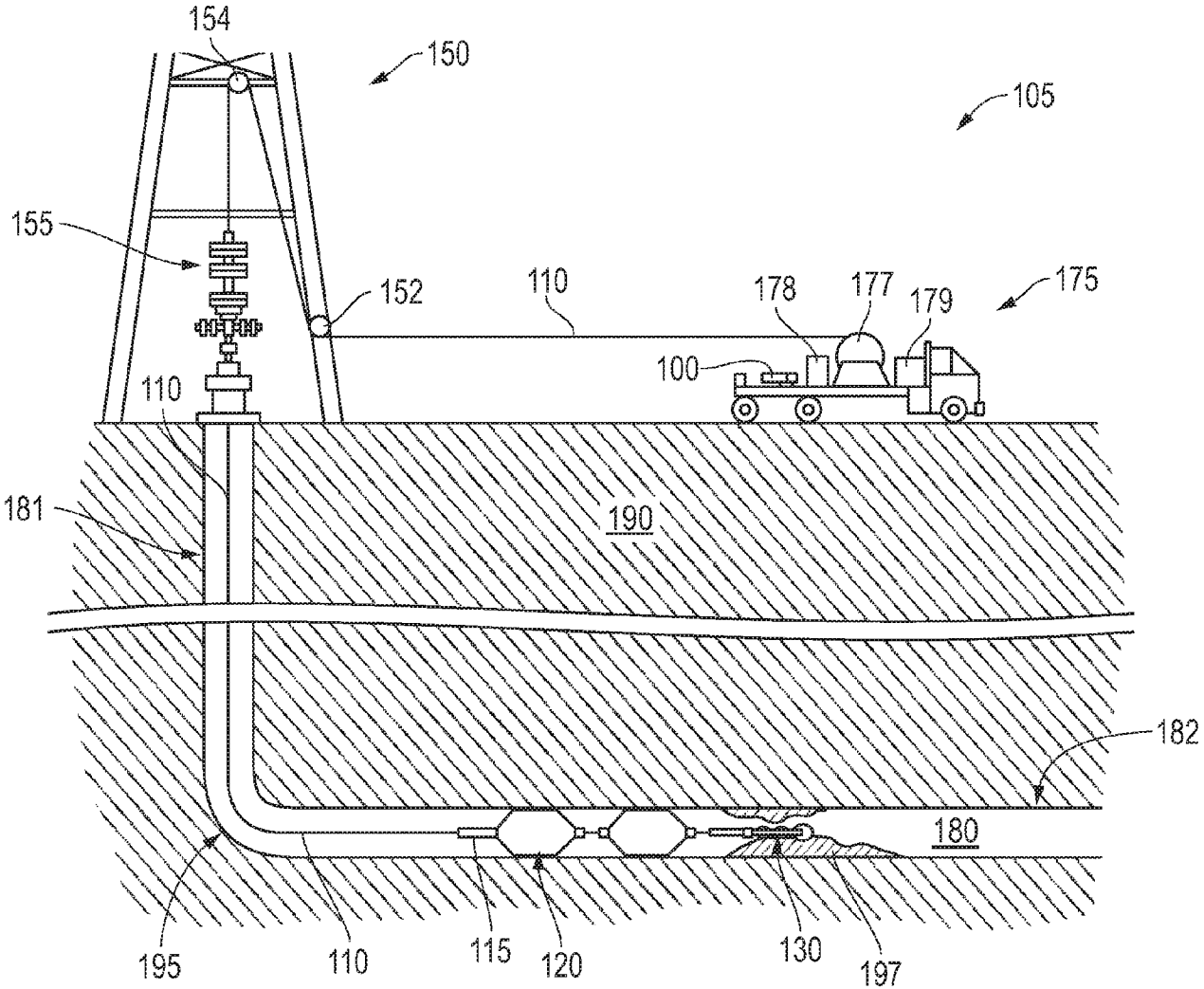
FIG. 1 is a side overview of an oilfield with an embodiment of a cutting tool thereat for cutting a non-tubular well access line of a tool stuck in a well.

Referring now to FIG. 1, a side overview of an oilfield 105 is shown with a well 180 running through a formation 190 thereat. The well 180 includes a vertical section 181 that transitions into a lateral section 182 as it rounds a bend 195. In the embodiment shown, a downhole logging tool 130 is driven through the well 180 by way of a downhole tractor 120 to obtain diagnostic information relative to the well 180. For example, pressure, temperature, flow and other readings may be obtained through such an application.

The above noted tractor 120 and logging tool 130 are delivered to the depicted downhole location by way of a well access line in the form of a wireline cable 110. The wireline cable 110 may provide telemetric and powering capacity between the tractor 120 and/or logging tool 130 and surface equipment, such as a processing unit 178 and power unit 179. As shown, the wireline cable 110 is delivered to the oilfield 105 by way of a wireline truck 175 accommodating the noted equipment along with a drum 177 about which the wireline cable 110 is wound. Additionally, as described in greater detail below, a cutting tool 100 is provided in the event that that the logging tool 130 and/or tractor 120 become stuck downhole in the well 180.

The wireline cable 110 is run from the drum 177 to a rig 150 where it is strung about sheaves 152, 154 and ultimately directed through well access and regulation equipment 155, often referred to as a 'Christmas tree'. This equipment 155 includes blowout prevention and other valve mechanisms to allow for the coupling downhole tools 120, 130 to a cable head 115 at the end of the cable 110. Such tools 120, 130 may then be advanced through the well 180. Indeed, as shown in FIG. 1, the tractor 120 may be employed to drive the logging tool 130 to the location shown. Thus, the cable 110 traverses the well 180, eventually terminating at the in the lateral section 182 thereof.

However, in the embodiment of FIG. 1, the logging tool 130 is shown stuck in debris 197. In certain circumstances, this sticking may reach a point that the combined efforts of the tractor 120 and winch-powered drum 177 remain unable to dislodge the logging tool 130. Thus, cutting of the cable 110 followed by fishing out of the downhole tools 120, 130 may be in order. However, in cutting the cable 110, it may be of significance that the cut take place as close to the cable head 115 as possible. In this manner, the well 180 may be substantially free of cable 110 during the subsequent fishing operation. Therefore, in order to help ensure that the cable 110 is cut close to the cable head 115, the cutting tool 100 may be positioned about the cable 110 and directed into the well 180 toward the cable head 115 as detailed herein-below.

Figure 2:
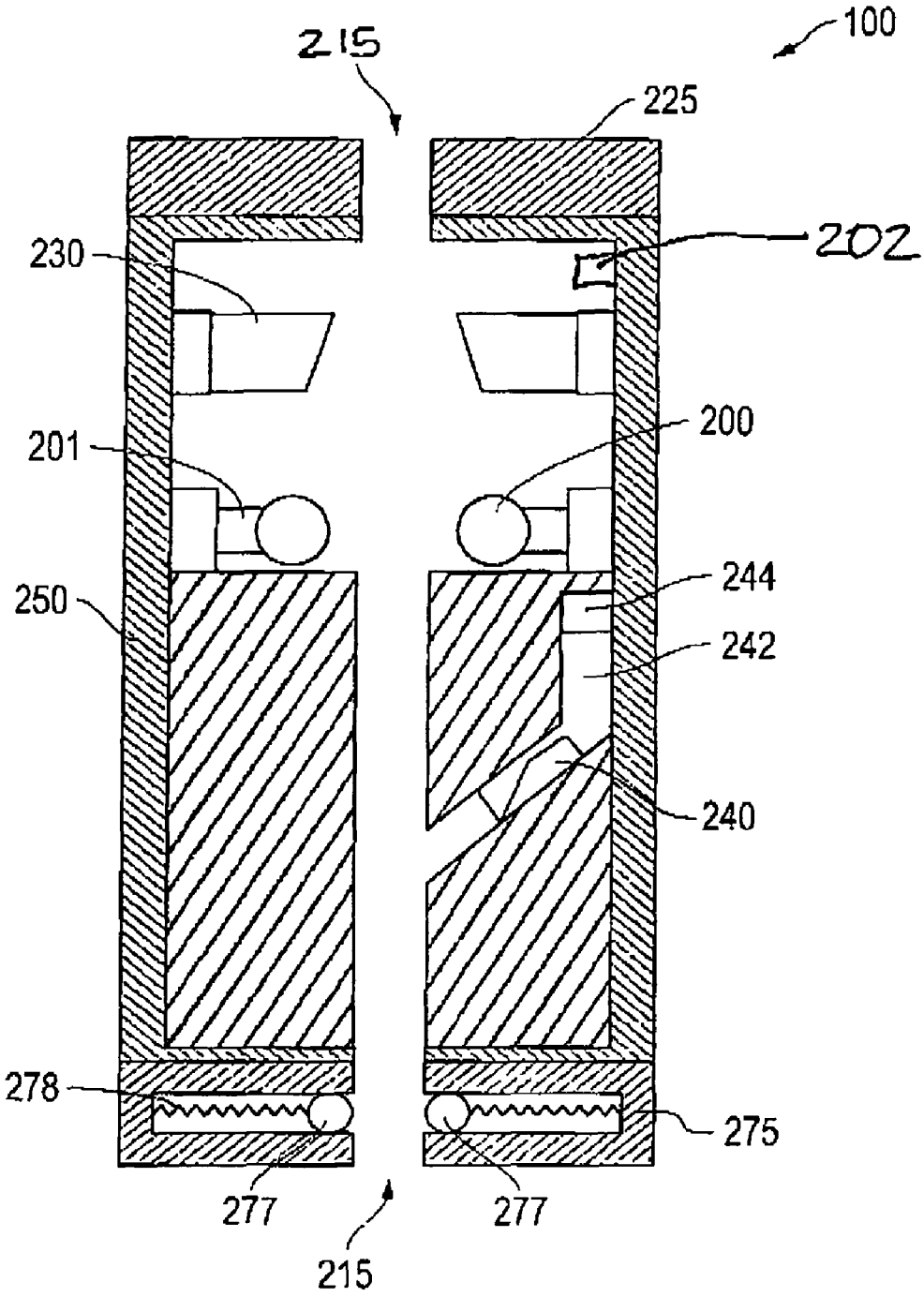
FIG. 2 is a side cross-sectional view of the cutting tool of FIG. 1.

With added reference to FIG. 2, a side cross-sectional view of the cutting tool is depicted. The cutting tool 100 is equipped with a line or cable space 215 running there-through to allow the tool 100 to be positioned about the cable 110 and dropped into the well 180. A blade 240 for cutting the cable 110 is provided for use once the tool 100 is properly positioned downhole. Along these lines the tool 100 is also equipped with an active propulsion mechanism in order to help properly position the tool 100 for the cutting. That is, as shown, the tool 100 includes wheels 200 disposed at the end of extension arms 201. Thus, at the appropriate time, the wheels 200 may grab onto the cable 110 in the space 215 and drive the tool 100 to the proper downhole location for cutting.

Continuing with reference to FIG. 2, the above noted propulsion mechanism is housed within a main housing 250 of the tool 100 along with a clamping mechanism 230 as described further below. Additionally, a power source 225 and locator housing 275 are each coupled to the main housing 250. The power source 225 may be a conventional battery such as an off-the-shelf lithium battery casing. In one embodiment, up to about 12 volts of power may be provided to the propulsion mechanism from the power source 225 so as to adequately drive the tool 100 downhole as described. Also, as detailed below, the clamping mechanism 230 may be activated to secure the tool 100 to the cable 110 in advance of the cutting thereof. Actuation of this clamping may be powered by the power source 225 or mechanically. Regardless, once clamping of the cable 110 is achieved at the location of the clamping mechanism 230, cutting of the cable 110 downhole thereof will result in securing of the tool 100 to a portion of the cable 110 that is now retractable about the drum 177 at surface.

The above noted locator housing 275 may house a locator mechanism such as bearings 277 which are biased by springs 278. As described below, the locator housing 275 may interface a cable head 115 as the tool 100 reaches a targeted location for cutting the cable 110. As this interfacing of the locator housing 275 and the cable head 115 occurs, the bearings 277 may be laterally displaced in a manner that effects compression of the springs 278. In the embodiments described herein-below, this compression of the springs 278 may be utilized as an indicator of tool location. Thus, signaling may be sent by conventional means throughout the tool 100 indicative of tool location. For example, spring compression may be employed as a trigger for actuation of the clamping mechanism 230, immediately followed by actuation of the cutting of the cable 110 by the blade 240.

Figure 4:
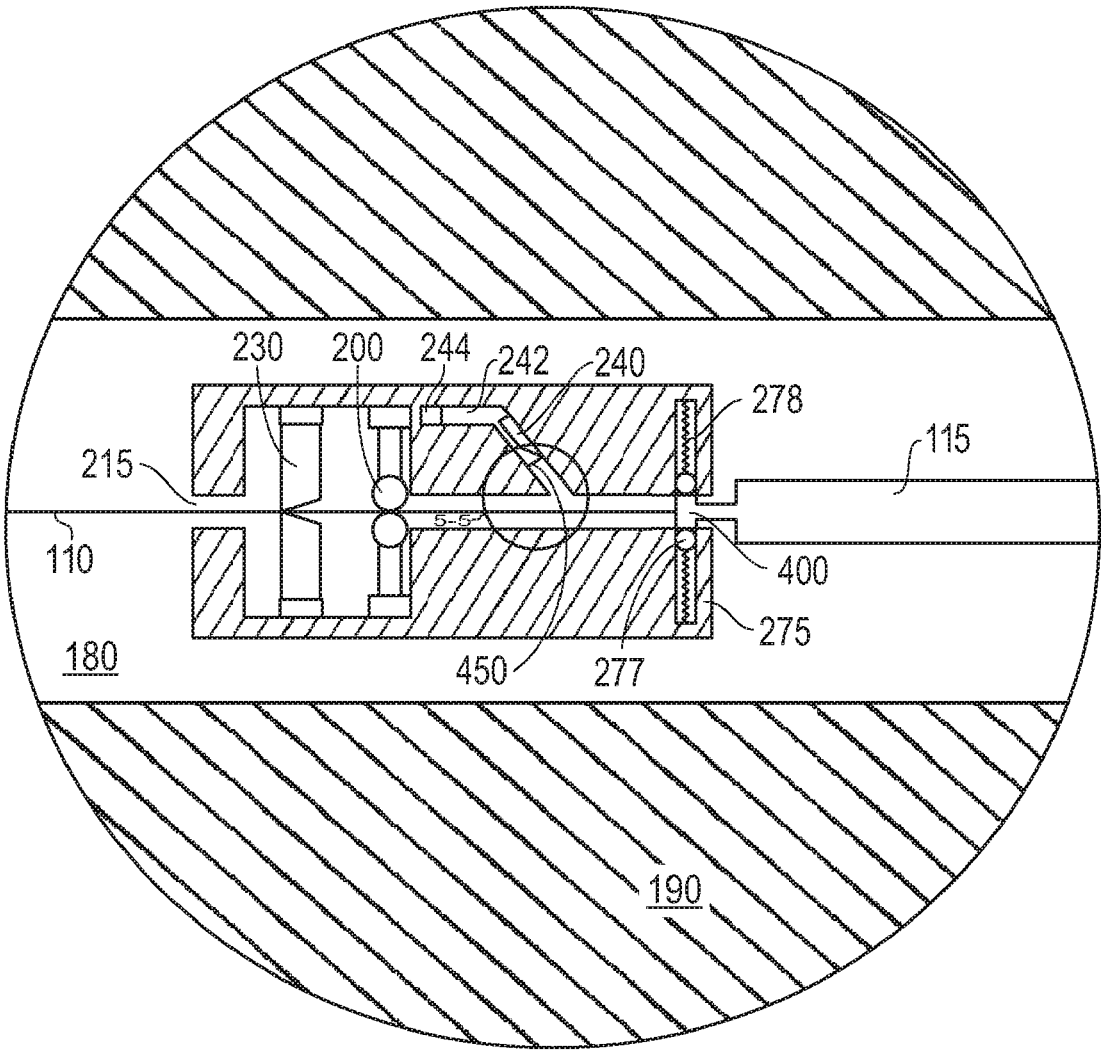
FIG. 4 is a side cross-sectional depiction of the cutting tool of FIG. 2 interfacing a cable head of the tool of FIG. 1.

As shown in FIG. 2, the blade 240 is retained within a chamber 242 by a membrane 450 (see FIG. 4). However, once the tool 100 reaches the cutting location as indicated by the above-noted interfacing, the blade 240 may be fired from the chamber 242 to achieve cutting of the cable 110. That is, a firing mechanism 244 such as an explosive charge, compressed gas or other conventional source may be employed to fire the blade 240 toward the cable 110 in order to attain cutting thereof. Once this process occurs as detailed below, the cable 110 with tool 100 clamped thereto may be retrieved from the well 180 and a follow-on fishing operation may ensue for retrieval of the cable head 115 and other downhole tools 120, 130.

Figure 3C:
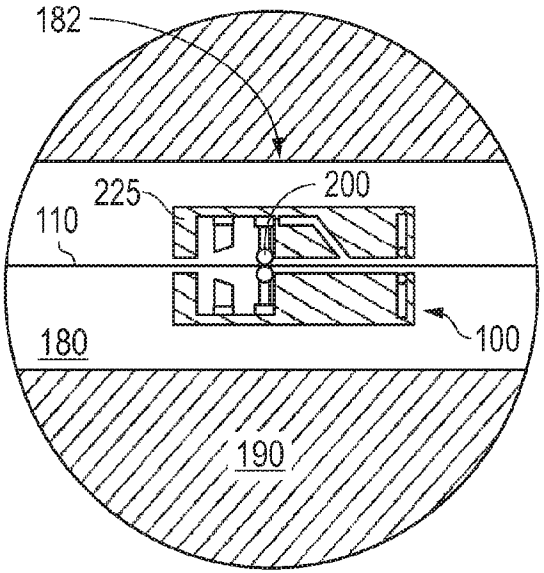
FIG. 3C is a side cross-sectional view of the cutting tool of FIG. 2 propelling along the well access line in a lateral section of the well of FIG. 1.
Figure 3B:
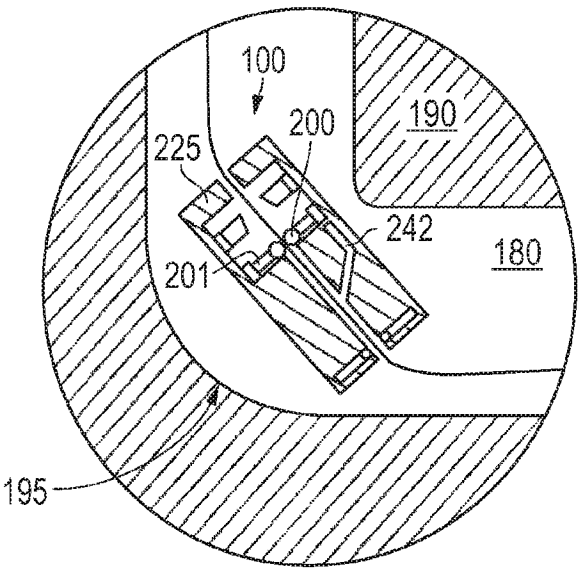
FIG. 3B is a side cross-sectional view of the cutting tool of FIG. 2 striking a bend in the well of FIG. 1.
Figure 3A:
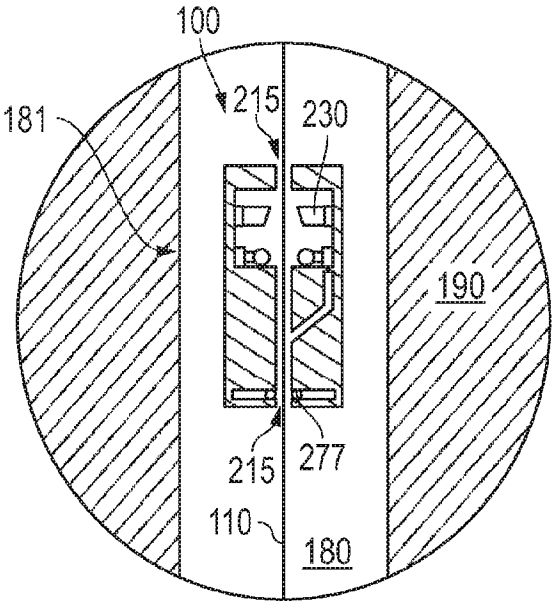
FIG. 3A is a side cross-sectional view of the cutting tool of FIG. 2 dropped into the well of FIG. 1 about the well access line therein.

Referring now to FIGS. 3A-3C, enlarged depictions of the cutting tool 100 making its way down the well 180 and through tortuous sections thereof are shown in greater detail. Of note is the fact that the tool 100 is guided through such well sections without prematurely triggering cutting of the cable 110. Rather, as traversing the well 180 becomes more challenging, the propulsion mechanism is employed to drive the tool 100 therethrough and toward a proper cut location as shown in FIG. 4.

With particular reference to FIG. 3A, the cutting tool 100 is shown dropped through the vertical section 181 of the well 180. At this point, the tool 100 freely drops with the cable 110 running through the cable space 215. There is no engagement of the clamping mechanism 230 or the wheels 200 relative to the cable 110. Indeed, in the embodiment shown, the tool 100 traverses the vertical section 181 of the well 180 without draining any power from the power source 225 (see FIG. 2).

As shown in FIG. 3B, the tool 100 eventually reaches the bend 195 in the well 180. In the embodiment shown, the impact of reaching the bend 195 may act as a trigger to activate the extension arms 201 of the propulsion mechanism. In this manner, the wheels 200 may engage the cable 110 and begin driving of the cutting tool 100 further through the well 180. That is, as opposed to triggering a cut of the cable 110 as in the case of a conventional cutting tool, the impact of the sudden stoppage of the depicted cutting tool 100 is to activate engagement of the propulsion mechanism. That is, a conventional motion sensor 202, best seen in FIG. 2, within the tool 100 may be employed to trigger engagement of the propulsion mechanism in lieu of cutting. Thus, premature cutting of the cable 110 may be avoided.

As shown in FIG. 3C, the wheels 200 of the propulsion mechanism may be powered by the power source 225 sufficiently to drive the tool 100 around the bend 195 of FIG. 3B. In fact, it is worth noting that no downhole powering of the tool 100 is generally required for dropping the tool 100 through the vertical section 181 of the well 180 or for removing the tool 100 from the well entirely (see FIG. 6). Thus, a conventionally available battery pack may sufficiently serve as the only downhole power source 225 for driving the tool 100.

Eventually, as depicted in FIG. 4, the cutting tool 100 may come to the cable head 115. Thus, a targeted location for cutting of the cable 110 has been reached. That is, a cut of the cable 110 made while the cutting tool 100 interfaces the cable head 115 may avoid leaving any significant amount of cable 110 in the well 180 following the cutting and retrieval operation. As described above, the wheels 200 may act to drive the tool 100 to interface the cable head 115.

Figure 5:
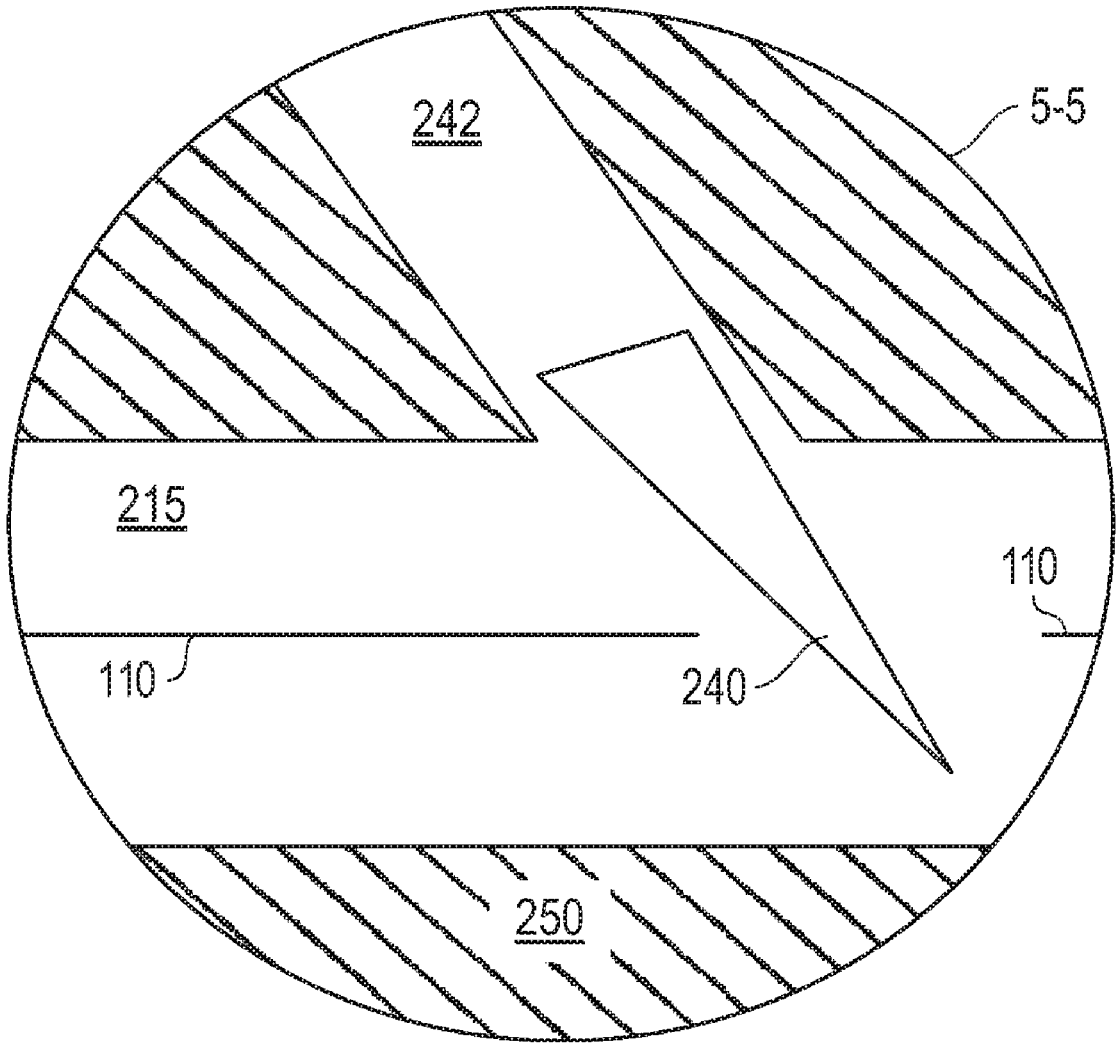
FIG. 5 is an enlarged view of the cutting tool taken from 5-5 of FIG. 4 depicted cutting the well access line of FIG. 1.

As shown in FIG. 4, the cable 110 may terminate at an extension 400 of the cable head 115. Thus, the extension 400 may be received by the locator housing 275 at the cable space 215 thereof. When this occurs, the bearings 277 may be displaced as described above such that the springs 278 are compressed. As such, locating of the tool 100 at the cut location may be communicated throughout the tool 100 by conventional means. In particular, clamping of the cable 110 by the clamping mechanism 230 may be initiated followed by actuation of cutting. As shown in FIG. 5, this may include firing of the blade 240 from the chamber 242 and through a retaining membrane 450 toward the cable 110. Such firing may be achieved through a firing mechanism 244 as described above. In an alternate embodiment, however, firing may be actuated when the propulsion mechanism is prevented from continued downhole advancement (e.g. when sticking is uphole of the cable head 115). Nevertheless, the firing takes place following driving by the propulsion mechanism and thus, in a less blind manner than conventional cutting.

With reference to FIG. 5, an enlarged view taken from 5-5 of FIG. 4 is shown, revealing the cutting of the cable 110 by the blade 240. In this view, the membrane 450 of FIG. 4 is eliminated as the blade 240 is fired from the chamber 242. The firing results in the cutting of the cable 110 within the cable space 215 as defined by the main housing 250 of the tool 100. Thus, while a small segment of cable 110 downhole of the cut may be left, the vast majority of the cable 110 is now free of any downhole sticking (see FIGS. 1 and 6).

Figure 6:
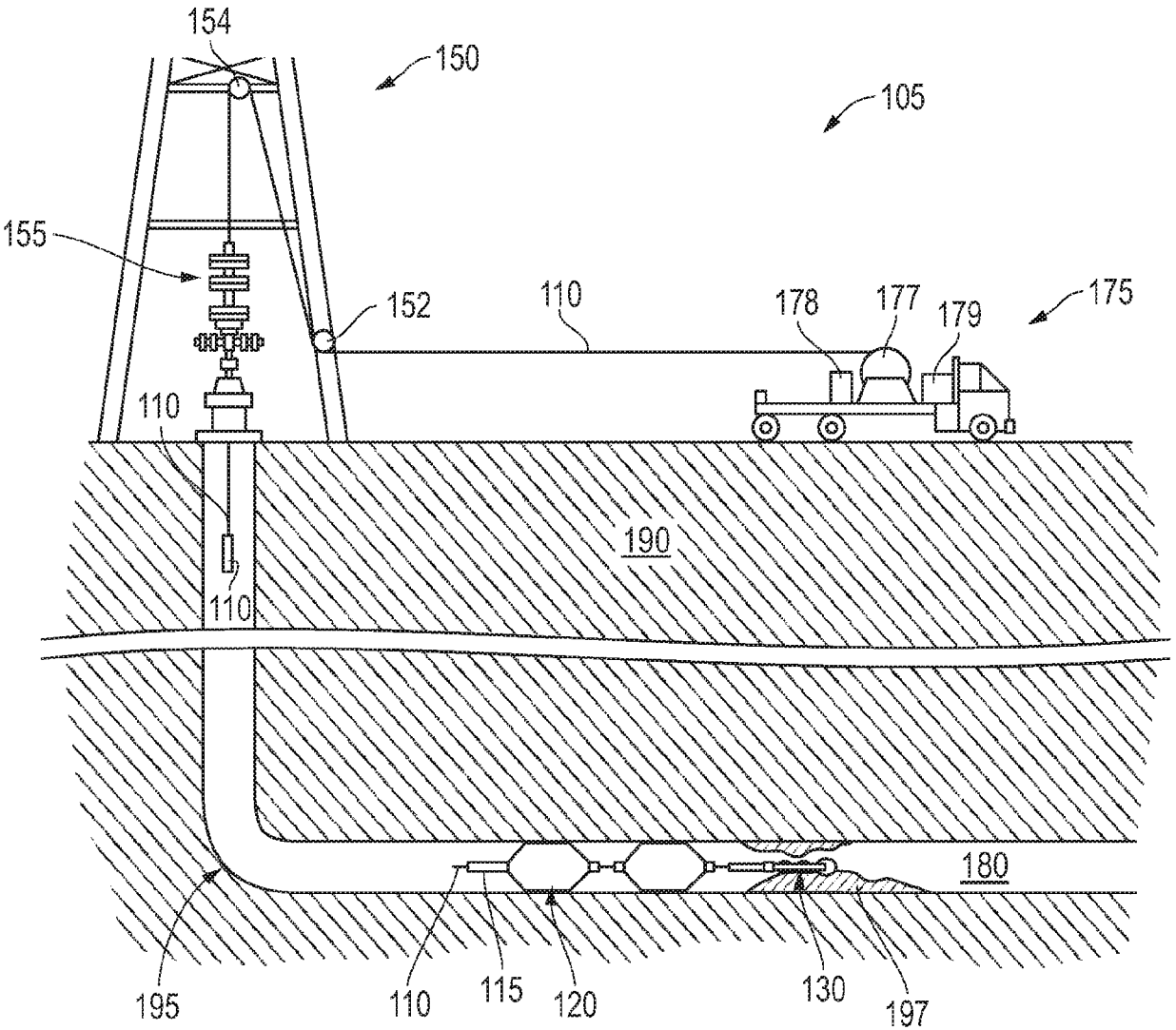
FIG. 6 is a side overview of the oilfield of FIG. 1 with the cutting tool and well access line retrieved from the well thereof.

Referring now to FIG. 6, the drum 177 may be employed to remove the severed cable 110 from the well 180. As such, the well 180 is cleared of any significant cable obstruction. With added reference to FIG. 4, the removal of the severed cable 110 also removes the cutting tool 100 from the well 180 due to the clamping of the clamping mechanism 230 about the cable 110. By the same token, the engagement between the extension 400 and the locator housing 275 may be of a matching, however, not a locked fashion. Thus, pulling on the cable 110 by the winding drum 177 may be sufficient to disengage the extension 400 and locator housing 275 so as to allow cable 110 and cutting tool 100 removal from the well 180. As such, follow-on fishing operations may proceed to remove the stuck downhole tools 120, 130 without concern over cable interference.

Figure 7:
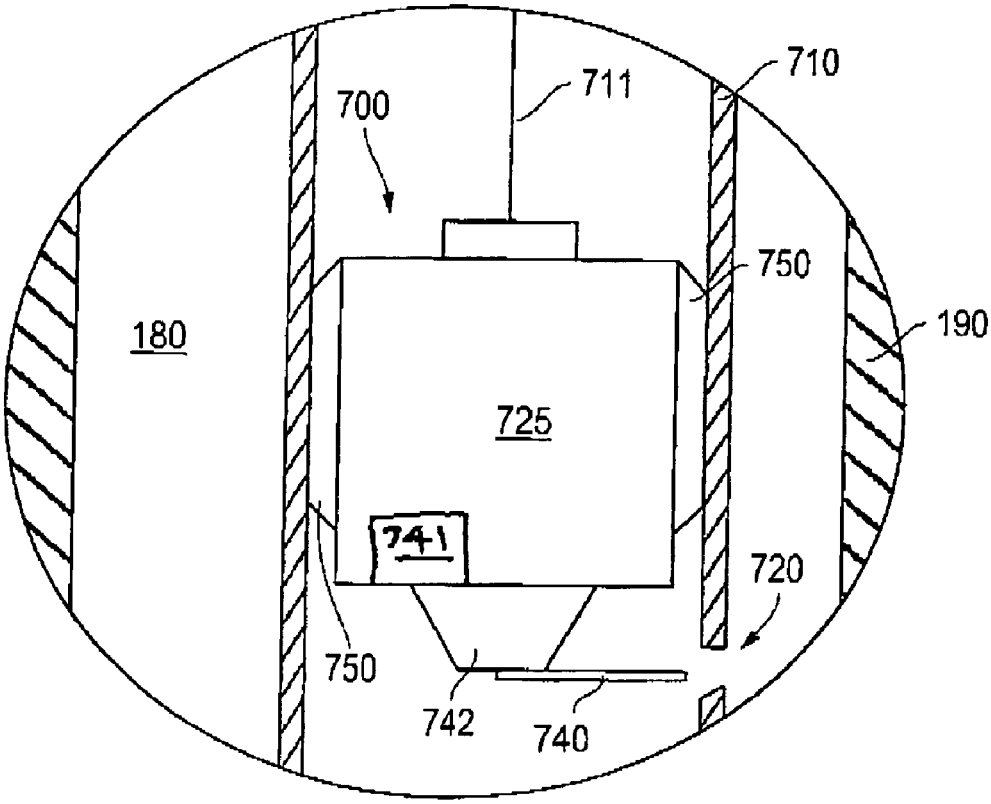
FIG. 7 is a depiction of an alternate embodiment of a cutting tool for cutting a well access line in the form of coiled tubing.

Referring now to FIG. 7, an alternate embodiment of a cutting tool 700 is shown. In this embodiment, the tool 700 is particularly configured for cutting well access line in the form of coiled tubing 710. That is, due to the larger diameter and hallow nature of the coiled tubing 710, the tool 700 is deployed within the tubing 710 as opposed to being deployed thereabout. In fact, the cutting tool 700 may be configured small enough to allow for introduction to the coiled tubing 710 at a coiled tubing reel at the surface of the oilfield 105. In this manner, cutting of the coiled tubing 710 at the surface may be avoided, thereby salvaging potentially several thousand feet of tubing 710 for future use.

Continuing with reference to FIG. 7, the main housing 725 is coupled to a drop line 711 and positioned within the coiled tubing 710 as shown. In the embodiment shown, the line 711 may have power delivering capacity built therein so as to meet power requirements of the tool 700. Additionally, given the generally unobstructed nature of a coiled tubing interior, pump assisted driving of the tool 700 may be employed. Indeed, the generally unobstructed nature of the coiled tubing 710 may make premature cutting due to locating error less of a concern. Nevertheless, the main housing 725 is equipped with a propulsion mechanism in the form of tracks 750 which extend outward and engage the interior walls of the coiled tubing 710. As such, the tool 700 may be stably driven to the downhole cut location.

Similar to the cutting tool 100 of FIGS. 1-6, the tool 700 may be advanced through the coiled tubing 710 in a relatively passive manner. For example, depending on the architecture of the well 180, pump assistance and gravity alone may be employed to drive the tool 700 through the majority thereof. However, motion sensing and/or other conventional mechanisms may also be employed such that the noted tracks 750 are deployed at some point in advance of the downhole cut location.

In one embodiment, the tool 700 is driven in this manner until a coiled tubing connector head is reached. At this point, an interfacing may be achieved similar to that detailed above for the cutting tool 100 of FIGS. 1-6. For example, a smaller diameter or other recognizable feature of the connector head may be encountered and employed as a location indicator. Thus, cutting as described below may ensue.

The cutting tool 700 of FIG. 7 is also equipped with a cutting extension 742 and blade 740 for extending outward and cutting the coiled tubing 710 (see cut 720). Due to the secure nature of the tracks 710 compressed against the tubing 710, a stable cut 720 may be made therein as the extension 742 and blade 740 are rotated about the tool 700. In an alternate embodiment, the blade 740 serves as a scoring device for scoring of the tubing 710 as opposed to complete cutting. Nevertheless, follow-on uphole pulling on the coiled tubing 710 may be employed to induce a coiled tubing break at the scoring location. Indeed, a corrosive chemical from a source 741 of corrosive chemical in the main housing 725 for example, may be sprayed from the extension 742 to enhance the breaking in the coiled tubing 710. In yet another embodiment, a corrosive alone, without any prior scoring or cutting, may be employed in a manner sufficient to allow uphole pulling to induce the break in the tubing 710.

Figure 8:
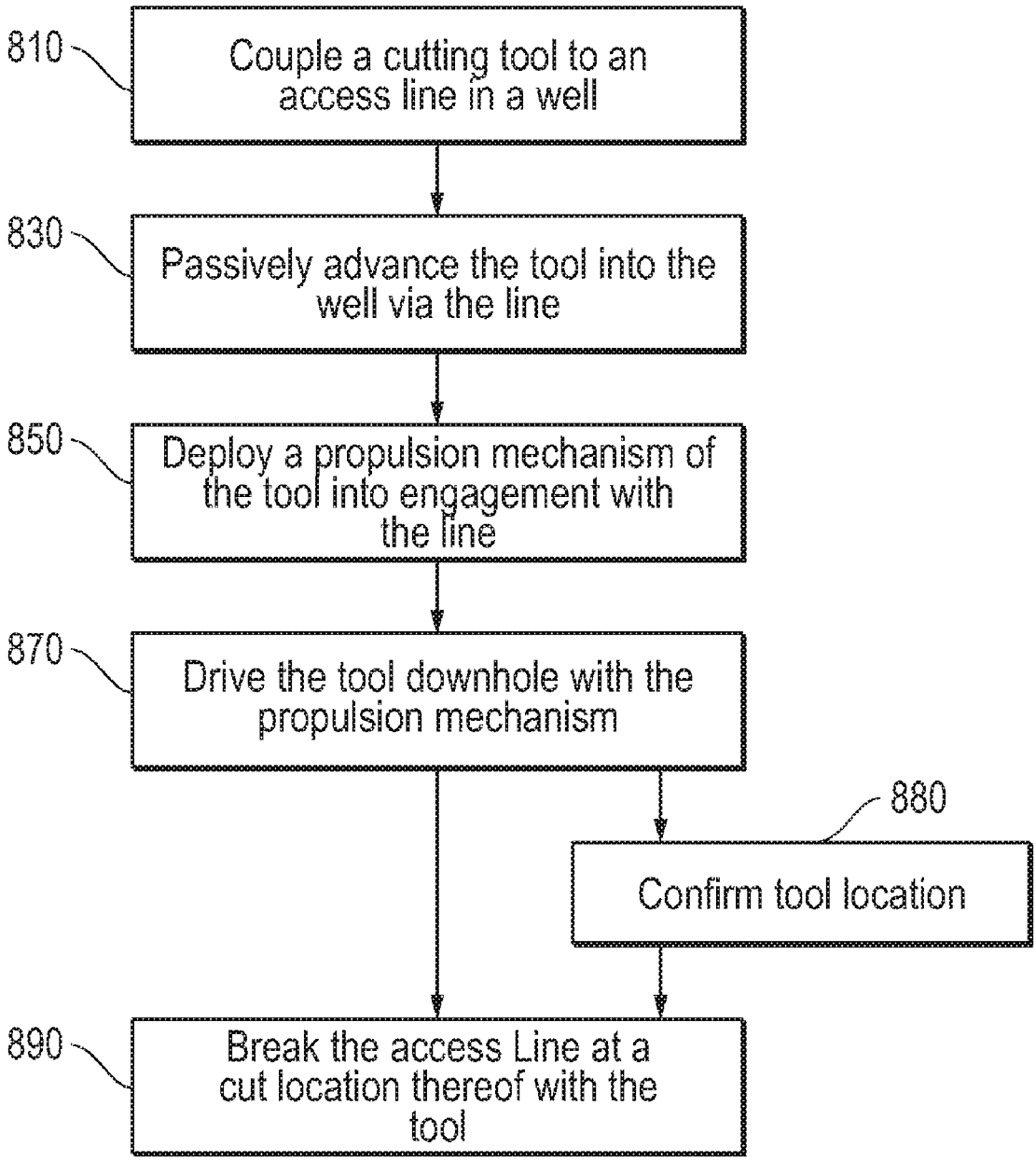
FIG. 8 is a flow-chart summarizing embodiments of employing cutting tools as described in FIGS. 1-7 for cutting well access lines in a well.

Referring now to FIG. 8, a flow-chart is shown which summarizes embodiments of employing cutting tools as detailed hereinabove. The cutting tools are initially coupled to a well access line to be cut as indicated at 810 and then passively advanced into the well as indicated at 830. In the case of wireline or other non-tubular well access this may involve coupling the cutting tool about the line and manipulating well access and regulation equipment such as blow out prevention valving. Thus, the cutting tool may then be dropped into a vertical portion of the well. In the case of coiled tubing, on the other hand, this may involve positioning the cutting tool within the tubing at a coiled tubing reel and employing pump assistance to advance the tool to the vertical portion of the well. Regardless, at this point, the advancement of the tool may be achieved without any active propulsion from the tool itself and thus, is considered herein as 'passive' advancement.

At some point, the tool may reach a bend in the well or other obstruction sufficient to halt passive advancement thereof. A conventional motion sensor within the cutting tool may be employed to detect such a halt. When this occurs, a propulsion mechanism of the tool may be deployed as indicated at 850 to engage the line. As noted above the propulsion mechanism may engage the line by either outward or inward extension, for example, depending upon the type of line and cutting tool involved. Regardless, the propulsion mechanism may thus be employed to drive the tool further downhole as indicated at 870.

The tool may be advanced as described above until reaching a cut location. In the case of non-tubing access such as wireline, confirmation of the tool reaching the cut location may be particularly beneficial as detailed hereinabove. Thus, as indicated at 880, such cut location may be confirmed, for example, based on an interface achieved between the cutting tool and a cable head. Of course, similar location confirmation techniques may also be employed where the well access line is coiled tubing. In any case, once the cut location is attained by the cutting tool, a break may be induced in the line as indicated at 890.

Embodiments detailed hereinabove provide cutting tools and techniques that may be employed in manners that enhance certainty and accuracy of well access line cutting. The cutting tools may be employed in manners that need not rely exclusively on timers, motion sensors, or other blind mechanisms for triggering cutting of a well access line. This may be particularly beneficial in the case of non-tubular access cutting where actuation of cutting based on such mechanisms is prone to trigger cutting as a response to downhole obstructions or at a point in time that the cutting tool is caught on such an obstruction. Additionally, in the case of coiled tubing, cutting tools and techniques are detailed which may avoid the cutting of the tubing at the well surface, thereby saving potentially several thousand feet of coiled tubing.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, a cutting tool for severing a non-tubular well access line may be employed with an outward extending propulsion mechanism similar to that described for use on coiled tubing. In such an embodiment, the propulsion mechanism may engage a well wall as opposed to the line interior thereof. By the same token, space permitting, a cutting tool for coiled tubing may be employed about the coiled tubing with inwardly extending propulsion mechanism similar to that described herein for use on non-tubular access lines. With modifications such as these in mind, the foregoing description should not be read as pertaining only to the precise structures described and shown in the accompanying drawings, but rather should be read as consistent with and as support for the following claims, which are to have their fullest and fairest scope.

I claim:

1. A cutting tool for a non-tubular well access line, the tool comprising:

a housing;

an active propulsion mechanism disposed within said housing that engages the well access line, driving the cutting tool along the well access line to a cut location thereof; and a cutting mechanism disposed within said housing for cutting the well access line at the cut location.

2. The cutting tool of claim 1 further comprising a locator mechanism coupled to said housing for interfacing with a head coupled to a downhole tool at the cut location.

3. The cutting tool of claim 1 further comprising a power source coupled to said housing to power the driving.

4. The cutting tool of claim 3 wherein said power source is a lithium battery configured to supply up to about 12 volts of power.

5. The cutting tool of claim 1 further comprising a motion sensor by disposed within said housing to signal said active propulsion mechanism to engage the well access line and drive the cutting tool.

6. The cutting tool of claim 5 wherein said active propulsion mechanism is configured to extend for the engaging relative to said housing in one of an inward direction where the well access line is non-tubular and an outward direction where the well access line is coiled tubing.

7. A cutting tool for a non-tubular well access line disposed in a well, the cutting tool comprising:

a housing defining a line space therein to allow the well access line to pass therethrough;

an active propulsion mechanism disposed within said line space for driving the cutting tool over the well access line to a cut location thereof; and a cutting mechanism disposed within said line space for cutting the well access line at the cut location.

8. The cutting tool of claim 7 further comprising a clamping mechanism disposed in said line space uphole of said cutting mechanism, said clamping mechanism configured for clamping the cutting tool to the well access line.

9. The cutting tool of claim 8 further comprising a locator mechanism coupled to said housing for interfacing with a cable head coupled to a downhole tool at the cut location.

10. The cutting tool of claim 9 wherein said locator mechanism comprises bearings for displacement during the interfacing for actuating the clamping and the cutting thereafter.

11. The cutting tool of claim 7 wherein said cutting mechanism comprises:

a fire-able blade disposed in a chamber defined by a body of said housing; and a firing mechanism in communication with the chamber.

12. The cutting tool of claim 11 wherein said firing mechanism is one of an explosive charge and a compressed gas.

13. The cutting tool of claim 7 wherein said active propulsion mechanism comprises:

extension arms for extending toward the line space; and wheels coupled to said extension arms for engaging the well access line in the line space.

14. The cutting tool of claim 7 wherein the non-tubular well access line is one of wireline and slickline.

15. A method of removing a non-tubular well access line stuck in a well at an oilfield, the method comprising:

coupling a cutting tool to the well access line, the cutting tool comprising a housing comprising a cutting mechanism and an active propulsion mechanism disposed therein;

driving the cutting tool along the well access line to a cut location of the well access line by engaging the well access line with the propulsion mechanism;

cutting the well access line at the cut location with the cutting tool; and withdrawing the well access line uphole of the cut location from the well with equipment at the oilfield.

16. The method of claim 15 wherein said cutting comprises one of:

employing a blade to break the well access line at the cut location;

employing a blade to score the well access line at the cut location; and delivering a corrosive chemical to the cut location.

17. The method of claim 15 further comprising passively advancing the cutting tool through a vertical section of the well prior to said driving.

18. The method of claim 17 wherein driving comprises activating the propulsion mechanism of the cutting tool for said driving.

19. The method of claim 18 wherein said activating comprises:

sensing a halt in said advancing; and deploying the propulsion mechanism to one of engagement with a non-tubular configuration of the well access line interiorly disposed relative to the cutting tool and engagement with a coiled tubing configuration of the well access line exteriorly disposed relative to the cutting tool.

20. The method of claim 19 wherein the well access line is of the non-tubular configuration, the method further comprising clamping the cutting tool to the well access line uphole of the cut location prior to said cutting, said withdrawing further comprising retrieving the cutting tool.

21. The method of claim 15 further comprising:

interfacing the cutting tool with a head at the downhole end of the well access line;

recognizing said interfacing as indicative of the cut location; and initiating said cutting in response to said recognizing.

22. The method of claim 21 further comprising fishing a downhole tool coupled to the head from the well after said withdrawing.

* * * * *